US007431037B2

(12) United States Patent
Hering et al.

(10) Patent No.: US 7,431,037 B2
(45) Date of Patent: Oct. 7, 2008

(54) WASHING METHOD FOR A DISHWASHER, AND DISHWASHER FOR CARRYING OUT ONE SUCH METHOD

(75) Inventors: Reinhard Hering, Holzheim (DE); Michael Rosenbauer, Reimlingen (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 0 days.

(21) Appl. No.: 10/538,050

(22) PCT Filed: Nov. 20, 2003

(86) PCT No.: PCT/EP03/13042

§ 371 (c)(1),
(2), (4) Date: Jun. 8, 2005

(87) PCT Pub. No.: WO2004/054425

PCT Pub. Date: Jul. 1, 2004

(65) Prior Publication Data

US 2006/0076038 A1 Apr. 13, 2006

(30) Foreign Application Priority Data

Dec. 17, 2002 (DE) ..... 102 59 060

(51) Int. Cl.
*B08B 3/00* (2006.01)

(52) U.S. Cl. ..... 134/58 R; 134/18; 134/25.2; 134/56 D; 134/56 R; 134/57 D; 134/57 DL; 134/58 D; 134/58 DL; 134/113

(58) Field of Classification Search ..... 134/18, 134/25.2, 56 R, 57 D, 57 DL, 56 D, 58 D, 134/58 DL, 113, 58 R
See application file for complete search history.

(56) References Cited

U.S. PATENT DOCUMENTS

| | | | | |
|---|---|---|---|---|
| 4,249,090 | A | 2/1981 | Cushing | |
| 2002/0151992 | A1 * | 10/2002 | Hoffberg et al. | 700/83 |

FOREIGN PATENT DOCUMENTS

| | | | |
|---|---|---|---|
| CH | 691 344 | A5 | 7/2001 |
| DE | 199 34 121 | A1 | 2/2000 |
| DE | 101 22 182 | A1 | 11/2002 |
| EP | 0 269 917 | A2 | 6/1988 |
| EP | 0 505 684 | A2 | 9/1992 |
| FR | 2 138 626 | A | 1/1973 |
| FR | 2 504 002 | A3 | 10/1982 |
| JP | 7-227374 | A | 8/1995 |
| JP | 07-313435 | * | 12/1995 |
| JP | 7-313435 | A | 12/1995 |
| JP | 2006102005 | * | 4/2006 |

OTHER PUBLICATIONS

International Search Report for PCT/EP2003/013042.

* cited by examiner

*Primary Examiner*—Michael Barr
*Assistant Examiner*—Rita R Patel
(74) *Attorney, Agent, or Firm*—Russell W. Warnock; James E. Howard

(57) ABSTRACT

A method for washing and drying items in a dishwasher and a dishwasher are provided. After the door of the dishwasher has been closed, a washing program and then a drying program are executed. In response to both an interruption of the drying program resulting in the dishwasher no longer running its drying program and a thereafter following restoration of execution of the drying program, a parameter value is measured and the drying program is resumed if there is no predetermined deviation from a nominal value and, on the other hand, a fresh cycle of a washing program and a drying program is initiated in the event of a predetermined deviation.

6 Claims, 1 Drawing Sheet

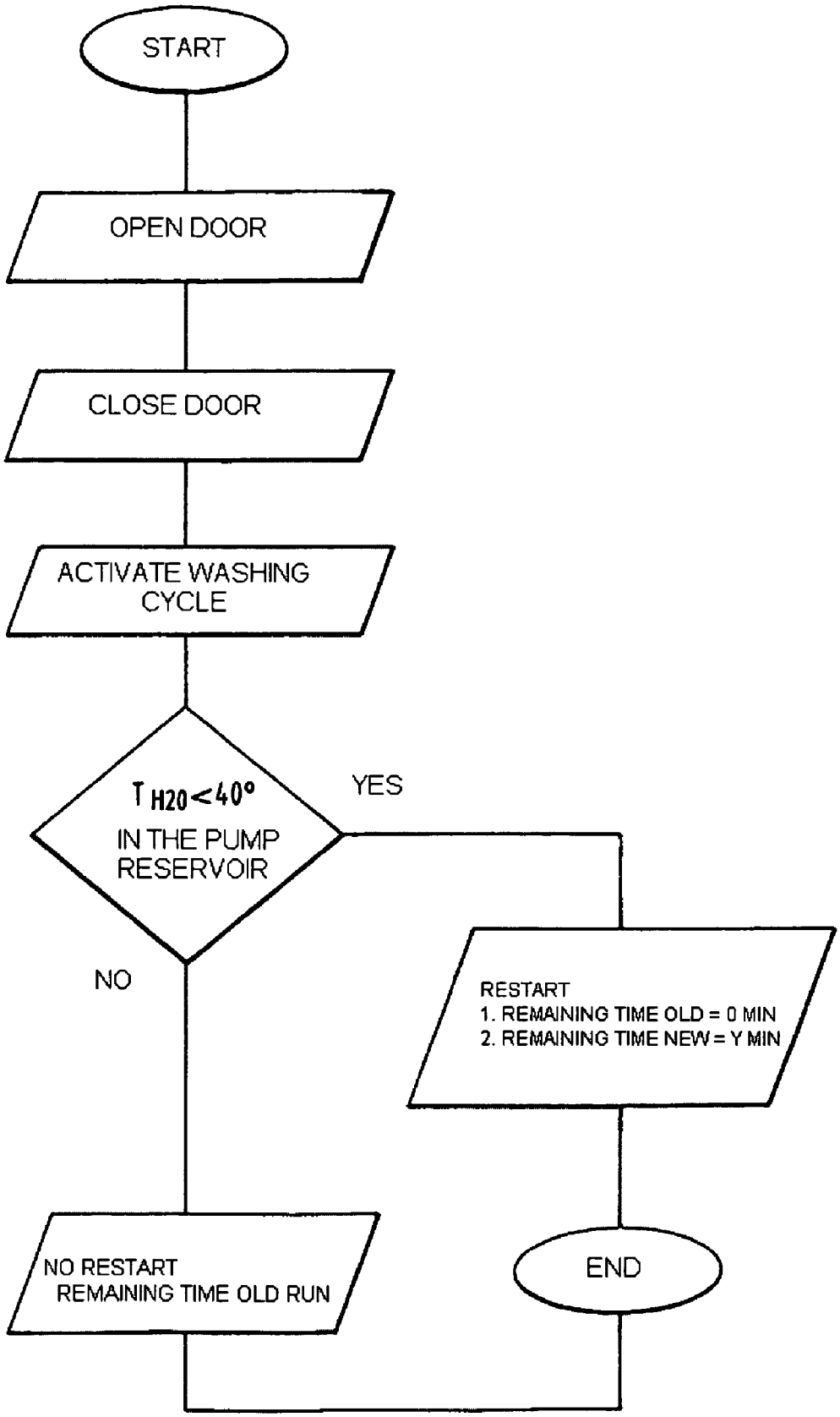
START
OPEN DOOR
CLOSE DOOR
ACTIVATE WASHING CYCLE
T H20<40°
IN THE PUMP RESERVOIR
YES
NO
RESTART
1. REMAINING TIME OLD = 0 MIN
2. REMAINING TIME NEW = Y MIN
NO RESTART
REMAINING TIME OLD RUN
END

WASHING METHOD FOR A DISHWASHER, AND DISHWASHER FOR CARRYING OUT ONE SUCH METHOD

BACKGROUND OF THE INVENTION

The subject matter of the invention is a washing method, especially a method for determining and generating a certain state of a washing program in a dishwasher and a dishwasher for implementing this method.

In conventional dishwashers whilst a washing program is running, the respective state of the washing is communicated to the user, e.g. by means of a time-remaining display which indicates the time remaining before the end of the washing program. This is also carried out during the partial drying section of the program. By means of this time remaining of the washing program which is usually indicated in a display on the front, the user who has sufficient experience with the particular dishwasher, can reliably estimate when the partial drying section of the program begins in the particular washing program, i.e., the user can estimate when the partial rinsing section of the program has ended and if necessary, heating of the atmosphere in the washing container for the purpose of drying the washed items begins.

In conventional dishwashers, during so-called "adding on" it is possible to briefly interrupt the washing program by opening the dishwasher to receive crockery in a washing program which has already begun. After closing the dishwasher door, the washing program is usually continued, i.e. a program controller saves the state existing at the time of opening the dishwasher door and after closing the dishwasher door, goes on from precisely this time to continue the selected washing program.

However, this usual interruption regulation for the washing program is disadvantageous for an interruption during the partial drying section of the program since an interruption of the washing program during the partial drying section of the program by the user is not used to add items for washing but to completely interrupt the partial drying section of the program before the time remaining elapses and either to remove the cleaned items immediately from the dishwasher or to speed up the drying process with the dishwasher door open.

If, following such a premature interruption of the partial drying section of the program, the dishwasher which has meanwhile been emptied, is again loaded with dirty items and the washing program started, the program controller does not recognise that a new washing program is to be started but merely recognises, as a result of the state stored in the program controller, that a program interruption has been made during the partial drying section of the program. After activating the program start, a countdown of the time remaining would begin and after this time remaining has ended, the dishwasher would be in a readiness state but would not start the desired washing program. For example, if the partial drying section of the program is ended 6 minutes before its actual completion by opening the dishwasher door, after activating the next program start a time remaining of 6 minutes must elapse before the user could activate the new washing program. The time delay and the associated double burden for the user of having to wait for a certain time remaining after a first activation of the washing program to re-activate the dishwasher has proved disadvantageous.

BRIEF SUMMARY OF THE INVENTION

The object of the present invention is thus to provide a method and a dishwasher able to differentiate between a desired brief interruption of the partial drying section of the program and an actual termination of the partial drying section of the program.

This object is solved by the method according to the invention having the features according to claim 1 and a dishwasher having the features according to the further independent claim. Advantageous further developments of the present invention are characterised in the dependent claims.

In the washing method according to the invention, following an interruption in a partial drying section of the program and once the program has been restarted, a parameter value is measured and compared with a pre-determined nominal value and if the measured parameter value deviates from the nominal value in a pre-determined manner, the selected program is set back to the beginning.

According to a preferred feature of the invention, following an interruption in a partial drying section of the program and once the program has been restarted, the temperature of a liquid in a dishwasher is measured and if the measured temperature is lower than the nominal value, the selected program is set back to the beginning.

More appropriately, the selected program is set back to the beginning immediately after the washing program has been activated.

The nominal value is preferably set at about 40° Centigrade.

In a dishwasher according to the invention comprising at least one program controller and comprising at least one sensor, following an interruption in a partial drying section of the program and once the program has been restarted, a parameter value is measured by means of the sensor and compared with a stored pre-determined nominal value in the program controller, and if the measured parameter value deviates from the nominal value in a pre-determined manner, the program controller sets the selected program back to the beginning.

According to a preferred feature of the invention, in the dishwasher according to the invention the at least one sensor is at least one temperature sensor which is arranged and embodied to measure the temperature of a liquid in a pump reservoir of a circulating pump; that the dishwasher has means suitable for detecting an interruption of the washing program at least during the partial drying section of the program and passing this on to the program controller and that following an interruption in a partial drying section of the program and once the program has been restarted, the temperature of the liquid in a pump reservoir of a circulating pump of a dishwasher is measured using the temperature sensor and if the measured temperature is lower than the nominal value, the program controller sets the selected program back to the beginning.

More appropriately, the selected program is set back to the beginning immediately after the washing program has been activated.

The nominal value is preferably set at about 40° Centigrade.

Advantageously, the means for detecting the interruption of the partial drying section of the program is coupled to a door lock of the dishwasher so that when the dishwasher door is opened, a signal is generated which initiates the activation of the method according to the invention in the program controller.

The method according to the invention is activated according to the invention when the partial drying section of the washing program is interrupted by opening the dishwasher door. The interruption signal generated by the means for detecting the interruption of the partial drying section of the program, which is coupled to the door lock of the dishwasher, is stored in the program controller and after the dishwasher door has been closed and the program run has been reactivated, results in measurement of the liquid temperature in the pump reservoir of the circulating pump.

If a liquid temperature of 50° C. or 60° C. is present for example, the program controller assumes that the interruption of the partial drying section of the program is such a short time ago that by shutting the dishwasher door and actuating the program selector switch, the user wished to continue the partial drying section of the program. However, if after activating the program selector switch and starting the program, a liquid temperature of less than about 40° C. is measured in the circulating pump, the program controller assumes that the interruption of the partial drying section of the program has at the same time resulted in complete termination of the partial drying section of the program by the user and understands the activation of program starting as a re-start with the consequence that the program controller sets the selected program back to the beginning, with the time remaining of the interrupted partial drying section of the program being set to zero and the initial value for the new washing program being used as the running time (e.g. 73 minutes).

The present invention provides a method and a dishwasher able to differentiate between a desired brief interruption of the partial drying section of the program and an actual termination of the partial drying section of the program.

BRIEF DESCRIPTION OF THE DRAWINGS

The invention is explained in detail subsequently with reference to the program flow diagram of a preferred exemplary embodiment of the method according to the invention shown in the single figure.

DETAILED DESCRIPTION OF THE INVENTION

According to a preferred variant, the method according to the invention is started with the opening and closing of a door of a dishwasher according to the invention in the partial drying section of the program wherein, after the washing program has been re-activated by the user, an interrogation routine begins with a nominal/actual value comparison where the liquid temperature in the pump reservoir is interrogated as the parameter at a temperature sensor.

Since the nominal value in the exemplary embodiment shown is specified as 40° C., if a liquid temperature of 40° C. or colder is detected, the program controller terminates the partial drying section of the program and sets the old time remaining to zero. Instead, a new washing program is started and a new time remaining is determined which corresponds to the program time of the selected washing program at the beginning of the new washing program. After outputting the new time remaining, the method according to the invention is terminated.

If the liquid temperature is above 40° C., the program controller decides not to restart the washing program and the partial drying section of the program and the old time remaining continues to run. The method according to the invention is also terminated with this action which is indistinguishable to the user.

The choice of temperature of 40° C. for the nominal value can vary in different countries or regions, e.g. the nominal temperature can be specified as 50° C. or a higher temperature and equally as a temperature lower than 40° C.

The present invention provides a method and a dishwasher able to differentiate between a desired brief interruption of the partial drying section of the program and an actual termination of the partial drying section of the program.

The invention claimed is:

1. A dishwasher for subjecting items to a dishwashing operation, the dishwasher comprising:

means for executing a washing program during which a washing liquid is applied to items in the dishwasher; and means for executing a drying program during which items that have been wetted during a washing program are subjected to drying; and means for controlling the dishwashing operation of the dishwasher such that, in response to both an interruption of an ongoing execution of the drying program and a resumption of the execution of the drying program, a parameter value is measured and analyzed to determine whether a predetermined deviation of the measured parameter value from a nominal value is present or absent and, in a first given circumstance, the drying program is resumed if an absence of the predetermined deviation from a nominal value is determined and, in a second given circumstance, the washing program and the drying program are restarted if a presence of the predetermined deviation is determined.

2. A dishwasher according to claim 1, wherein the means for controlling the operation of the dishwasher includes at least one sensor for measuring the parameter value and the means for controlling the operation of the dishwasher is operable to compare the parameter value measured by means of the sensor with a stored nominal value and to restart the washing program and the drying program if the measured parameter value deviates from the stored nominal value in a predetermined manner.

3. The dishwasher according to claim 2, wherein the at least one sensor is at least one temperature sensor operable to measure a temperature of a liquid in a pump reservoir of a circulating pump and the means for controlling the operation of the dishwasher includes means for detecting an interruption of a drying program and the means for controlling the operation of the dishwasher controls the at least one temperature sensor to measure the temperature of the liquid in a pump reservoir of a circulating pump of the dishwasher and to compare the parameter value measured by the at least one temperature sensor with a stored nominal value and to restart the washing program and the drying program in the event of that the measured parameter value is lower than the stored nominal value.

4. The dishwasher according to claim 2, wherein the at least one sensor is at least one temperature sensor operable to measure the temperature of a liquid in a pump reservoir of a circulating pump and the means for controlling the operation of the dishwasher includes means for detecting an interruption of an ongoing execution of a drying program and the means for controlling the operation of the dishwasher controls the at least one temperature sensor to measure a temperature of the liquid in a pump reservoir of a circulating pump of the dishwasher and to compare the parameter value measured by the at least one temperature sensor with a stored nominal value of about 40° C. and to restart the washing program and the drying program in the event of that the measured parameter value is lower than the stored nominal value of about 40° C.

5. The dishwasher according to claim 1, wherein means for controlling the operation of the dishwasher is operable, in response to both an interruption of an ongoing execution of the drying program resulting in the dishwasher no longer being in a program execution readiness state and a thereafter following restoration of the dishwasher to its program execution readiness state, to initiate a drying program immediately upon the thereafter following restoration of the dishwasher to its program run state.

6. The dishwasher according to claim 1, wherein the means for controlling the operation of the dishwasher includes means for detecting the interruption of an ongoing execution of a drying program operatively coupled to a door lock of the dishwasher.

* * * * *